US005511653A

United States Patent [19]

Ovadia

[11] Patent Number: 5,511,653

[45] Date of Patent: Apr. 30, 1996

[54] JEWELRY TRAY

[76] Inventor: Joseph Ovadia, 109 Long Hill Rd., Little Falls, N.J. 07424

[21] Appl. No.: 245,030

[22] Filed: May 17, 1994

[51] Int. Cl.[6] ..... B65D 81/16; A47F 3/14

[52] U.S. Cl. ..... 206/6.1; 206/566; 220/627; 220/628; 220/630; 220/555

[58] Field of Search ..... 206/6.1, 566, 45.19, 206/561; 220/555, 556, 626, 627, 628, 630, 441, 623, 639

[56] References Cited

U.S. PATENT DOCUMENTS

| | | | |
|---|---|---|---|
| 1,681,092 | 8/1928 | Bulova | 206/45.19 |
| 1,907,681 | 5/1933 | Sundee | 206/565 |
| 2,501,379 | 3/1950 | Cranston | 206/561 |
| 2,574,099 | 11/1951 | Gessler | 206/561 |
| 3,266,704 | 8/1966 | Deeren | 206/561 |
| 3,583,623 | 6/1971 | Golner | 220/608 X |
| 3,601,277 | 8/1971 | Andrews | 206/558 |
| 3,724,654 | 4/1973 | Gerard et al. | 206/558 |
| 4,022,345 | 5/1977 | Butz | 220/630 |
| 4,139,096 | 2/1979 | Sieger | 220/555 |
| 4,349,124 | 9/1982 | Faller | 220/608 X |
| 4,432,456 | 2/1984 | Ovadia et al. . | |
| 4,671,407 | 6/1987 | Brutosky | 206/503 |
| 4,917,235 | 4/1990 | Feiler | 206/566 |
| 5,273,153 | 12/1993 | Braun | 206/566 |
| 5,273,154 | 12/1993 | Braun | 206/566 |

FOREIGN PATENT DOCUMENTS

| | | | |
|---|---|---|---|
| 3938558 | 12/1990 | Germany | 206/566 |
| 9015558 | 12/1990 | WIPO | 206/566 |

*Primary Examiner*—Paul T. Sewell
*Assistant Examiner*—Marie Denise Patterson
*Attorney, Agent, or Firm*—Richard M. Goldberg

[57] ABSTRACT

A jewelry tray includes a plastic grid-like frame including a peripheral supporting wall and a grid structure connected therewith, the grid structure including a intersecting bars that define a plurality of openings; a thin sheet of plastic forming a skin on an upper surface of the frame and extending within the openings to define a plurality of recesses, each recess being defined by a peripheral side wall and a bottom wall, each peripheral side wall extending along sides of the intersecting bars and extending beneath the bars for each recess to define undercut portions at a lower end of the peripheral side wall in each recess; a bottom closing member secured to an underside of the frame and including a short peripheral wall and a central wall of a generally planar configuration connected within and to the short peripheral wall, the central wall including a plurality of twist resistance ribs for providing a resistance to twisting of the jewelry tray and the short peripheral wall including a plurality of reinforcing ribs for providing a resistance to inward crushing of the side walls of the jewelry tray; and a plurality of deformable and resilient pads for holding jewelry items, each pad being held within a respective recess, each pad including a lower edge with a slightly protruding horizontal lip that extends outwardly therefrom for engaging with at least one undercut portion.

24 Claims, 7 Drawing Sheets

JEWELRY TRAY

BACKGROUND OF THE INVENTION

The present invention relates generally to display and storage devices, and more particularly, is directed to a jewelry tray having pads therein for storing and displaying items of jewelry, and a method of making the same.

A conventional jewelry tray includes a plurality of, for example, twelve, shallow closed-bottom recesses, with a cushioned pad held in each recess, with each cushioned pad being adapted to hold a jewelry item. For example, in one instance, the posts of earrings or the like can be inserted through the pads with the posts being held at the bottom of the pads by earring backings. In another instance, the pads may be provided with rectangular openings through which a ring can be inserted and held therein.

An example of one such jewelry tray is disclosed in U.S. Pat. No. 4,432,456 to Ovadia et al. Specifically, the jewelry tray is constituted by a open grid-like frame provided with a plurality of substantially square openings defined by a peripheral surrounding side wall having a peripheral lower lip for seating a pad thereon. Each side wall is made wider at its top than at its bottom, thereby forming an inwardly directed taper over the height of the side wall. Because of this taper, the pads are retained on the lower lip and within the openings.

In order to stack the jewelry trays one upon another, it is necessary that the lower end of the tray be open so that jewelry items mounted on pads of a lower tray can extend through openings in the next upper stacked tray.

Because of the configuration of the grid-like frame provided with openings, there is a relatively large flexibility of the grid-like frame so as to enable twisting of the same, which makes it undesirable from the standpoint of stackability and also results in the pads being less securely held in the openings, despite the tapered side walls. As a result, there is a problem of the pads falling out. To compensate for this problem, the grid-like frame must be made thicker during the molding operation so as to increase the rigidity thereof. However, this results in increased costs of material and also makes the jewelry tray heavier, which is undesirable for a salesman carrying many of such trays. In addition, this extra material does not entirely solve the flexibility problem.

Further, in order to retain the pads in the recesses by means of the taper of the walls, the walls must be made relatively high. Therefore, to remove the pads, central openings must be provided, or pull tabs must be provided. This, however, is undesirable since it is undesirable from a securing and use standpoint to continually lift the tray to press a finger through an opening in the bottom in order to remove a pad. Further, sometimes while holding the trays, a finger will accidently press a pad out of a recess. The tabs provide extra labor and distract from the look of the jewelry items that are held.

Further, although slight undercut portions have been provided in other jewelry trays formed by an injection molding process, these undercuts have been limited to corners of recesses of the jewelry tray, and are formed by means of pins in the mold. This, however, does not provide any significant hold of a jewelry pad, and the pad tends to become damaged over time, since all holding forces are in the corners thereof.

OBJECTS AND SUMMARY OF THE INVENTION

Accordingly, it is an object of the present invention to provide a jewelry tray that overcomes the problems with the aforementioned prior art.

It is another object of the present invention to provide a jewelry tray that is extremely rigid and resists twisting in any plane.

It is still another object of the present invention to provide a jewelry tray that includes a bottom closing member having a honeycomb rib structure that functions to resist twisting of the jewelry tray in any plane.

It is yet another object of the present invention to provide a jewelry tray that includes a bottom closing member with peripheral ribs that function to resist inward crushing of the side walls of the jewelry tray.

It is a further object of the present invention to provide a jewelry tray that is lightweight.

It is a still further object of the present invention to provide a jewelry tray which enables stacking of the jewelry trays one upon the other despite the use of a bottom closing member.

It is a yet further object of the present invention to provide a jewelry tray in which the lower outer peripheral edge of each jewelry tray is stackable upon an upper outer peripheral ledge of another jewelry tray, thereby providing the greatest strength while also avoiding damage to the most visible part of the jewelry tray.

It is another object of the present invention to provide a jewelry tray having an upper peripheral incline which aids in seating the lower outer peripheral edge of a jewelry tray upon the upper outer peripheral ledge of another jewelry tray during stacking of the same.

It is still another object of the present invention to provide a jewelry tray that securely holds the pads within the recesses thereof by means of an undercut in the side walls and corners of the recesses and a lip or taper on the pad.

It is yet another object of the present invention to provide a jewelry tray in which the pads have an inclined rear wall to permit easy removal of the pads from the recesses.

It is a further object of the present invention to provide a jewelry tray in which the pads have a non-planar configuration with a substantially constant thickness throughout.

It is a still further object of the present invention to provide a method of forming a jewelry tray by vacuum forming a thin sheet over a grid-like frame to provide a plurality of shallow closed-bottom recesses defined by side walls and a bottom wall, with the side walls and corners having an undercut therein.

It is a yet further object of the present invention to provide a method of forming a jewelry tray by securing a bottom closing member having a reinforcing pattern thereon to a grid-like frame.

In accordance with an aspect of the present invention, a jewelry tray includes a peripheral supporting wall; and a center portion connected within the peripheral supporting wall, the center portion including a plurality of recesses therein, each recess being defined by a peripheral side wall and a bottom wall, the bottom wall of each recess extending at least partially inwardly of the respective recess, each recess including an undercut portion extending at a lower end of the peripheral side wall thereof, and a portion of the bottom wall being disposed beneath each undercut portion to define an inner ledge for supporting a jewelry pad thereon.

The peripheral supporting wall includes outer tray supporting vertical wall means for supporting the jewelry tray on a surface; short stacking ledge means extending inwardly from an upper edge of the outer tray supporting vertical wall means for supporting a lower edge of the outer tray supporting vertical wall means of another the jewelry tray thereon; an inclined wall extending inwardly and upwardly from an inner edge of the short stacking ledge means; and inner center portion supporting vertical wall means extending downwardly from an inner, upper edge of the inclined wall and for supporting the center portion at a lower edge thereof.

According to one embodiment, the center portion includes a grid structure including a plurality of openings, and the jewelry tray includes a thin sheet of material formed as a skin on an upper surface of the grid structure so as to extend within the openings and partially surround a bottom of the grid structure, thereby defining the plurality of recesses, and the thin sheet of material extends outwardly from the center portion and is shaped thereat to form the peripheral supporting wall.

Specifically, the grid structure includes a plurality of intersecting bar means for defining the plurality of openings, the bar means meeting at intersecting corners.

The peripheral side wall of each recess extends along sides of the intersecting bar means and the intersecting corners, and extends beneath the bar means and/or the intersecting corners, for each recess so as to define at least one undercut portion at a lower end of the peripheral side wall in each recess.

A bottom closing member is secured to the peripheral supporting wall and to an underside of the center portion.

Further, a plurality of deformable and resilient pad means for holding jewelry items are provided, each pad means being held within a respective recess on the inner ledge thereof. Each pad means includes a lower edge with a slightly protruding horizontal lip that extends outwardly therefrom for engaging within at least one undercut portion.

In accordance with another aspect of the present invention, a jewelry tray includes a grid-like frame including a peripheral supporting wall and a grid structure connected within the peripheral supporting wall, the grid structure including a plurality of openings; a thin sheet of material forming a skin on an upper surface of the grid-like frame and extending within the openings to define a plurality of recesses; and a bottom closing member secured to an underside of the grid-like frame.

Adhesive means and/or RF welding secures an upper surface of the bottom closing member to undersurfaces of the bottom walls of the recesses.

In one embodiment, the grid-like frame includes a plurality of pin holes therein through which a vacuum can be applied for vacuum forming the thin sheet of material as a skin on the upper surface of the grid-like frame and so that the thin sheet extends within the openings to define the plurality of recesses.

In accordance with still another aspect of the present invention, a jewelry tray includes a frame including a peripheral supporting wall and a center portion connected within the peripheral supporting wall for holding jewelry items; and a bottom closing member secured to an underside of the frame, the bottom closing member including twist resistant rib means for resisting twisting of the jewelry tray.

The bottom closing member includes a short peripheral wall; and a central wall of a generally planar configuration connected within and to the short peripheral wall, and the rib means are provided in the central wall. Preferably, the rib means includes a plurality of ribs in a honeycomb configuration formed of a plurality of hexagons, and a plurality of hexagonal ribs formed within each hexagon of the honeycomb configuration.

In accordance with yet another aspect of the present invention, a jewelry tray includes a frame including a peripheral supporting wall and a center portion connected within the peripheral supporting wall for holding jewelry items; and a bottom closing member secured to an underside of the frame, the bottom closing member including rib means for resisting inward crushing of the supporting wall of the frame.

Specifically, the bottom closing member includes a short peripheral wall, and the rib means are provided in the short peripheral wall; and a central wall of a generally planar configuration is connected within and to the short peripheral wall.

In accordance with a further aspect of the present invention, a jewelry tray includes a frame including a peripheral supporting wall and a center portion connected within the peripheral supporting wall for holding jewelry items; and the supporting wall includes outer tray supporting vertical wall means for supporting the jewelry tray on a surface; short stacking ledge means at an upper edge of the outer tray supporting vertical wall means for supporting a lower edge of the outer tray supporting vertical wall means of another the jewelry tray thereon; an inclined wall extending inwardly and upwardly from an inner edge of the short stacking ledge means; and inner center portion supporting vertical wall means extending downwardly from an inner, upper edge of the inclined wall and for supporting the center portion at a lower edge thereof.

In accordance with a still further aspect of the present invention, a deformable and resilient jewelry pad for holding jewelry items in a recess in a jewelry tray, includes upper inclined wall means, extending upwardly and rearwardly from a front edge thereof, for receiving jewelry items therein; side walls, each having an upper inclined edge connected with a respective side edge of the inclined wall means; a rear wall having an upper edge connected with a rear edge of the inclined wall means and opposite side edges connected to rear edges of the side walls; and each pad having a substantially constant thickness throughout.

Each pad includes a lower edge with a slightly protruding horizontal lip that extends outwardly therefrom for engaging with at least one undercut portion of the recess in the jewelry tray. Further, the upper inclined wall means and the rear wall each have a substantially rectangular configuration and the side walls each have a substantially triangular configuration. In addition, the rear wall is inclined rearwardly from the upper inclined wall means.

The pad further includes reduced thickness areas, each reduced thickness area having at least one opening therethrough.

The above and other objects, features and advantages of the invention will become readily apparent from the following detailed description thereof which is to be read in connection with the accompanying drawings.

DETAILED DESCRIPTION OF THE PREFERRED EMBODIMENTS

Figure 1:
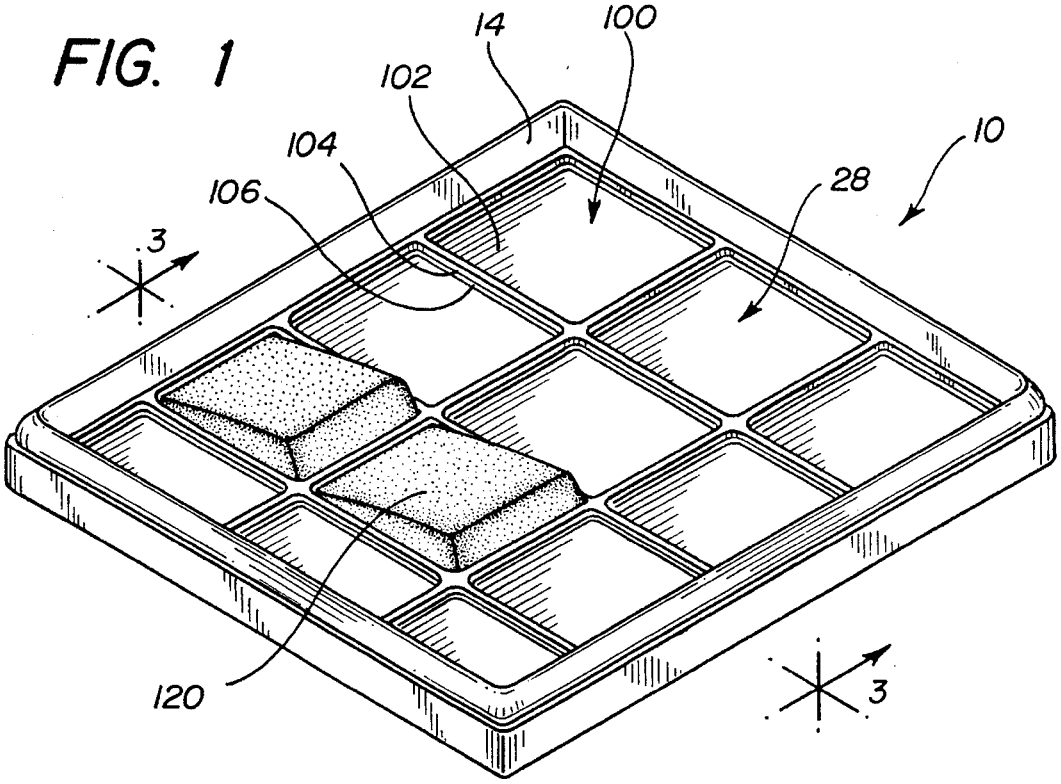
FIG. 1 is a perspective view of a jewelry tray according to one embodiment of the present invention.
Figure 3:
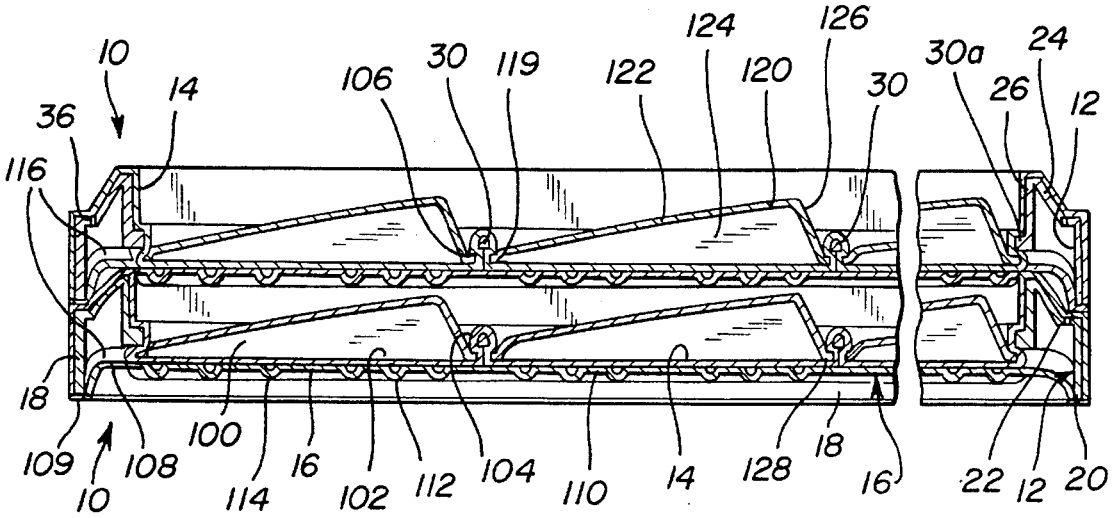
FIG. 3 is cross-sectional view of the jewelry tray of FIG. 1, taken along line 3—3 thereof.
Figure 2:
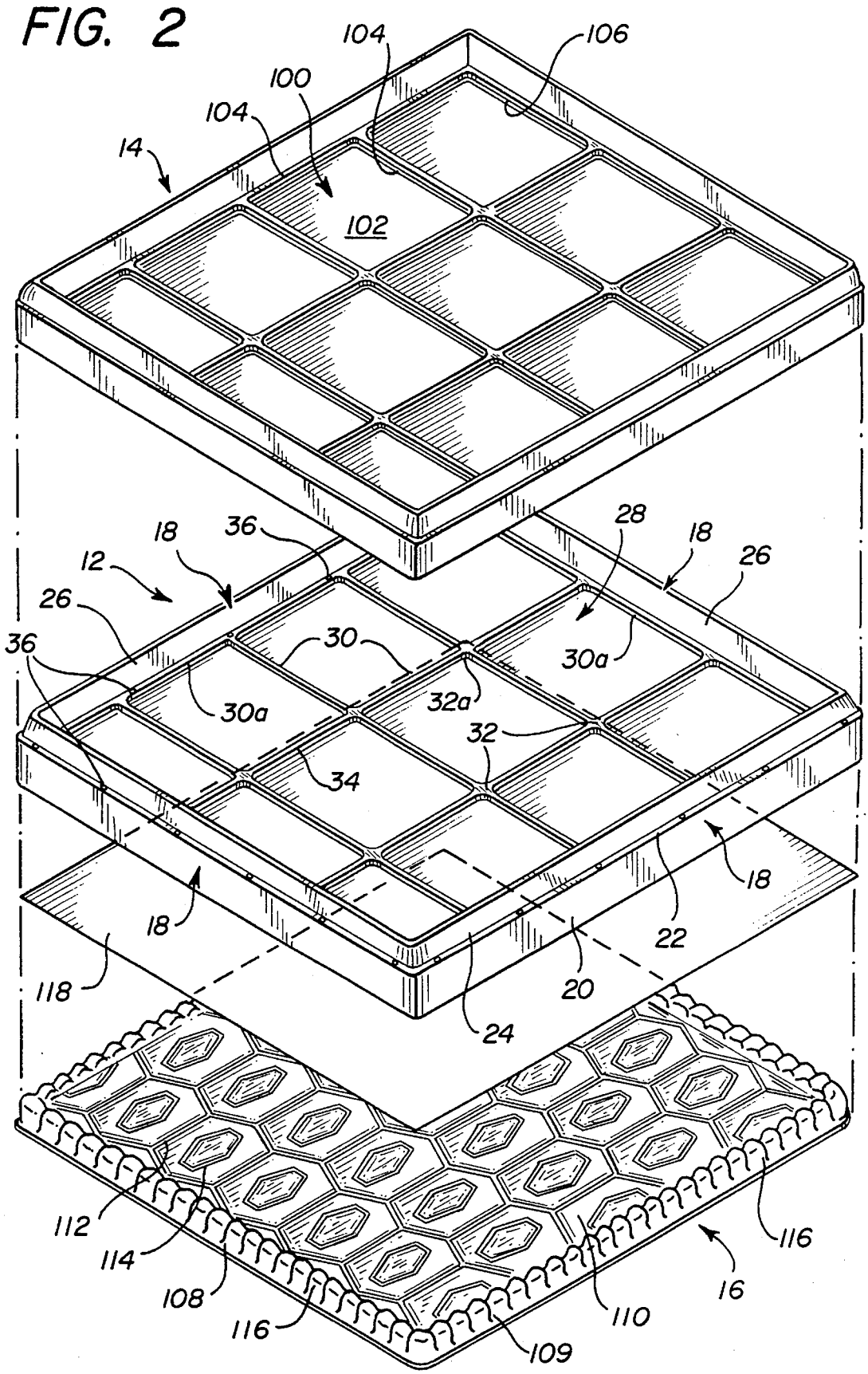
FIG. 2 is blown apart perspective view of the different parts of the jewelry tray of FIG. 1.

Referring to the drawings in detail, and initially to FIGS. 1–3 thereof, a jewelry tray 10 according to one embodiment of the present invention includes a molded grid-like frame 12, a thin sheet 14 of material vacuum formed thereover, and a bottom closing member 16 secured to the underside of grid-like frame 12 and to the underside of thin sheet 14 by means of RF welding and/or adhesive.

Specifically, grid-like frame 12 is a molded frame made from a tough, lightweight plastic. Frame 12 is shown in a rectangular configuration, although it is not so limited. Thus, frame 12 includes four connected side walls 18. Each side wall 18 is formed by an outer tray supporting vertical wall 20, a short stacking ledge 22 extending inwardly from the upper edge of outer tray supporting vertical wall 20, an inclined wall 24 extending inwardly and upwardly from the inner edge of short stacking ledge 22, and an inner grid supporting vertical wall 26 extending downwardly from the inner, upper edge of inclined wall 24 so as to be parallel and spaced inwardly of outer tray supporting vertical wall 20. Preferably, the lower edge of inner grid supporting wall 26 extends about mid-height of outer tray supporting vertical wall 20.

Frame 12 further includes a grid structure 28 secured to and within the confines of side walls 18. Specifically, grid structure 28 is secured to the lower edge of inner grid supporting vertical wall 26 so as to extend transversely thereto. Thus, when jewelry tray 10 is supported on a surface by means of outer tray supporting vertical walls 20, grid structure 28 lies in a substantially horizontal plane.

Grid structure 28 includes a plurality of intersecting bars 30 of a generally rectangular cross-sectional configuration. As shown in the drawings, outer peripheral ones **30*a* of bars 30 are connected with the lower edge of inner grid supporting vertical wall 26. Further, because bars 30 are intersecting, they meet at junctions 32. These junctions 32 have a generally four-sided hypocycloid configuration. As a result, bars 30 and junctions 32 define a plurality of openings 34 having slightly rounded corners 32*a*. Although twelve openings 34 are shown in a 3×4 matrix structure, it will be appreciated that the number and shape of openings 34 can vary within the scope of the present invention. It will also be appreciated that grid structure 28, because of openings 34**, is very flexible, and can therefore, be easily twisted.

In addition to the above, grid structure 28 includes a plurality of small pin-like openings 36 for use in a vacuum forming step which will be described hereinafter. Pin-like openings 36 are preferably formed through outer peripheral ones of bars 30 that are secured to inner grid supporting vertical wall 26, and are also formed through stacking ledges 22, so that a vacuum pressure can be applied therethrough from beneath grid-like frame 12.

Figure 4A:
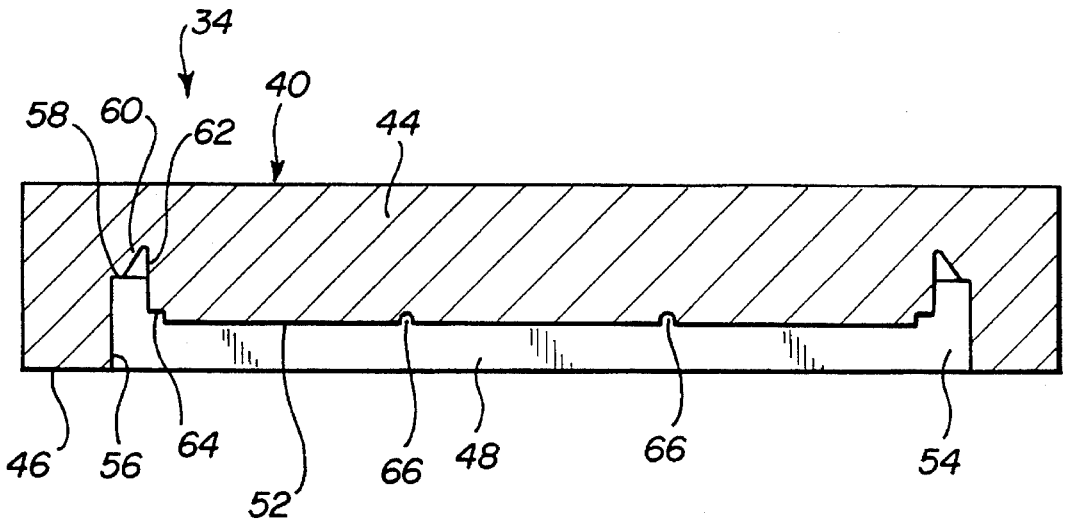
FIG. 4A is cross-sectional view of a female mold half for forming the grid-like frame of the jewelry tray of FIG. 1.
Figure 4B:
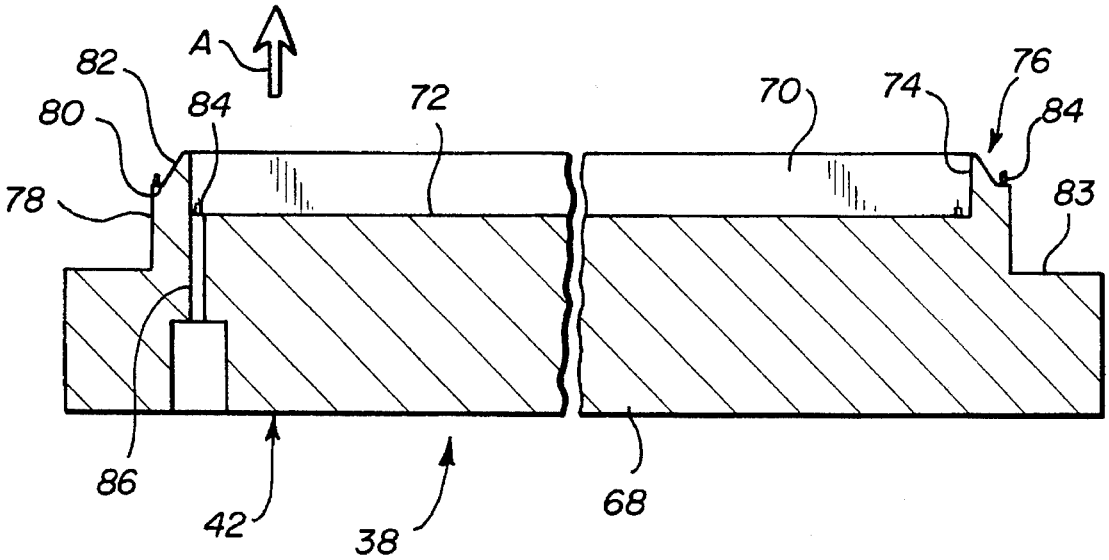
FIG. 4B is cross-sectional view of a male mold half which cooperates with the female mold half of FIG. 4A so as to form the grid-like frame of the jewelry tray of FIG. 1.

A frame mold 38 for forming grid-like frame 12 is shown in FIGS. 4A and 4B. As shown therein, frame mold 38 includes a female mold half 40 (FIG. 4A) and a male mold half 42 (FIG. 4B) which fits within female mold half 40.

Specifically, as shown in FIG. 4A, female mold half 40 includes a generally rectangular parallelepiped female mold half body 44 which is cut-away at its lower surface 46 to form a rectangular central recessed area 48 having a top wall 52, and a rectangular peripheral recessed area 54 in surrounding relation to central recessed area 48 and in communication therewith. Peripheral recessed area 54 has a configuration similar to side walls 18, and in this regard, is defined by an outer peripheral vertical wall 56 which is used to define outer tray supporting vertical wall 20, an inwardly directed peripheral short wall 58 extending inwardly from the upper edge of outer peripheral vertical wall 56 and which is used to define short stacking ledge 22, an inwardly directed peripheral inclined wall 60 extending upwardly from the inner free edge of inwardly directed peripheral short wall 58 and which is used to define inclined wall 24, and an inner peripheral vertical wall 62 extending downwardly from the free upper end of inclined wall 60 so as to be parallel and spaced inwardly of outer peripheral vertical wall 56 and which is used to define inner grid supporting vertical wall 26.

Further, a peripheral cut-out groove 64 is formed in top wall 52 immediately adjacent to and connected with inner peripheral vertical wall 62 so as to form outer peripheral ones **30*a* of bars 30 which are connected with the lower edge of inner grid supporting vertical wall 26. It will be appreciated that cut-out groove 64 extends in a rectangular configuration around top wall 52. Also, intersecting grooves 66 are formed in top wall 52 and are in communication with cut-out groove 64**.

Male mold half 42 includes complementary formations to female mold half 40 and fits within female mold half 40 in the direction of arrow A. Male mold half 42 includes a mold body 68 having an upper recessed area 70 defined by a bottom wall 72 and a peripheral side wall 74 arranged in a rectangular configuration. An upstanding rectangular vertical tower 76 is arranged in surrounding relation to recessed area 70. Specifically, upstanding rectangular vertical tower 76 has a configuration similar to side walls 18, and in this regard, is defined by an outer peripheral vertical wall 78 which cooperates with outer peripheral vertical wall 56 to define outer tray supporting vertical wall 20, an inwardly directed peripheral short wall 80 extending inwardly from the upper edge of outer peripheral vertical wall 78 and which cooperates with inwardly directed peripheral short wall 58 to define short stacking ledge 22, a peripheral inclined wall 82 extending inwardly and upwardly from the inner free edge of inwardly directed peripheral short wall 80 and which cooperates with peripheral inclined wall 60 to define inclined wall 24, and peripheral side wall 74 extending downwardly from the free upper end of inclined wall 82 so as to be parallel and spaced inwardly of outer peripheral vertical wall 78 and which cooperates with inner peripheral vertical wall 62 to define inner grid supporting vertical wall 26. In addition, male mold half 42 includes an outer horizontally oriented, peripheral limiting wall 83 that abuts against lower surface 46 of female mold half 40 when assembled therewith.

When male mold half 42 is assembled into female mold half 40, upstanding rectangular vertical tower 76 fits within rectangular peripheral recessed area 54. However, upstanding rectangular vertical tower 76 has a smaller dimension than rectangular peripheral recessed area 54 so as to form a space therebetween, in order to define the molding space for outer tray supporting vertical wall 20, short stacking ledge 22, inclined wall 24 and inner grid supporting vertical wall 26 of grid-like frame 12. Further, peripheral limiting wall 83 abuts against lower surface 46 of female mold half 40 to limit the height of outer tray supporting vertical wall 20. In addition, when male mold half 42 is assembled into female mold half 40, bottom wall 72 abuts against top wall 52, thereby leaving only the space of peripheral cut-out groove 64 and intersecting grooves 66, so as to define grid structure 28.

Pin-like openings 36 are formed by small pins 84 extending upwardly at spaced locations along the periphery of bottom wall 72 and along inwardly directed peripheral short wall 80. An injection port 86 is formed below the periphery of bottom wall 72 for injecting molten plastic therein. It will be appreciated that injection port 86 can be formed at any other suitable location, such as centrally of bottom wall 72 of male mold half 42 for insertion into an intersecting groove 66.

After frame 12 is formed in the above molding operation, thin sheet 14, which is in a planar form, is secured to the upper surface of frame 12 by a vacuum forming operation so as to conform to the shape of frame 12, as shown in FIGS. 2 and 3, and to form an outer skin thereover. Thin sheet 14 is preferably made from a polyvinyl chloride (PVC) material having a decorative pattern thereon.

Figure 5B:
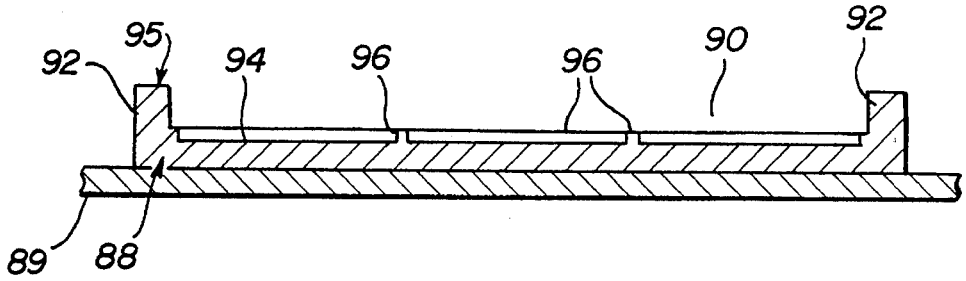
FIG. 5B is a cross-sectional view of the vacuum forming jig of FIG. 5A, taken along line 5B—5B thereof.
Figure 5A:
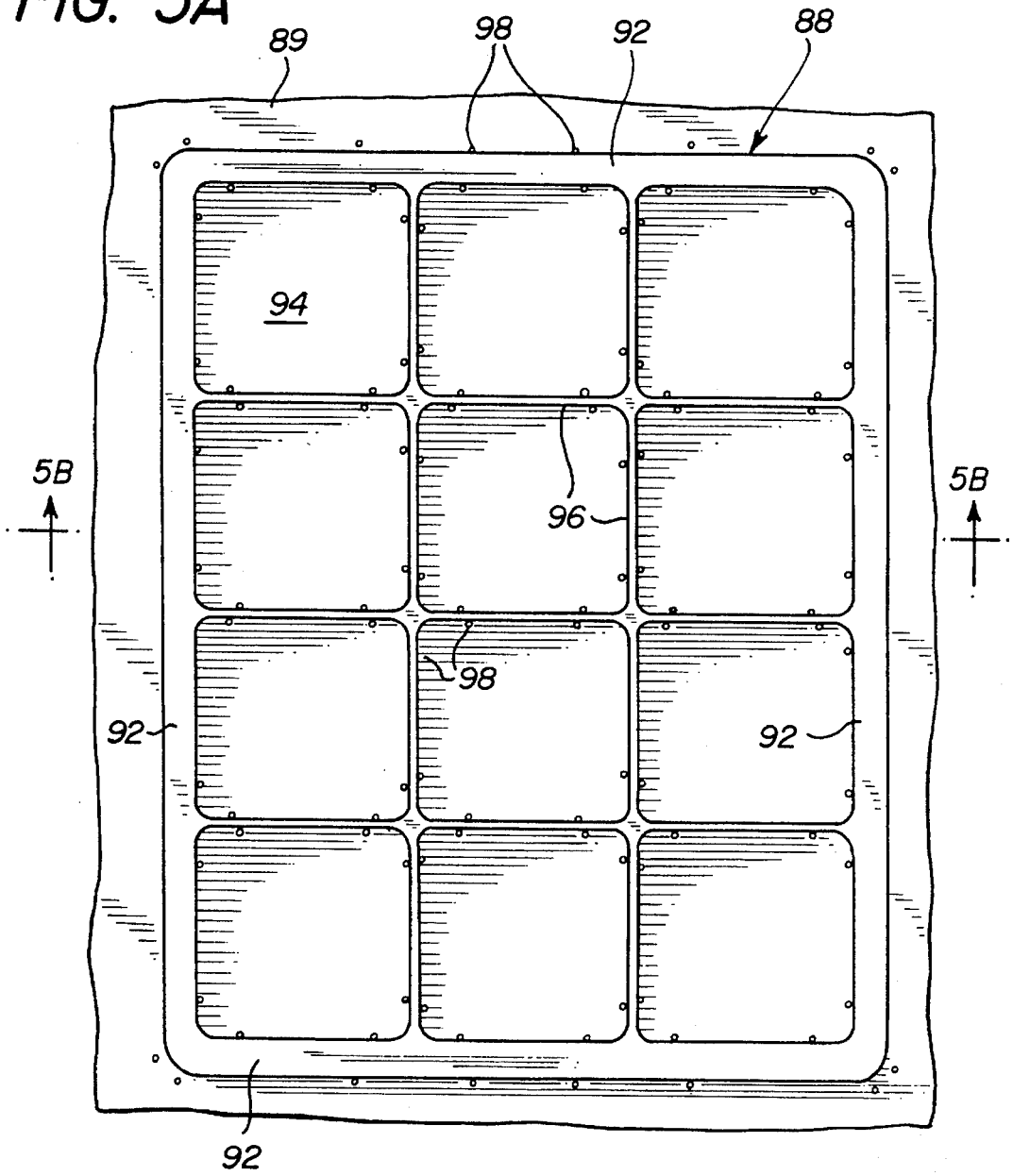
FIG. 5A is a top plan view of a vacuum forming jig for vacuum forming a thin planar sheet onto the grid-like frame.

A vacuum forming jig 88 for performing the vacuum forming operation is shown in FIGS. 5A and 5B. As shown therein, vacuum forming jig 88 seats on a vacuum plate 89 and has a generally rectangular parallelepiped configuration with an upper central recess 90 defined by four side walls 92 in a rectangular configuration and a rectangular bottom wall 94. Accordingly, a rectangular upstanding peripheral tower 95 is formed in surrounding relation to upper central recess 90. A plurality of supporting rails 96 are formed on the upper surface of bottom wall 94 in the same configuration and spacing as bars 30 of grid structure 28. However, supporting rails 96 have a smaller width than bars 30. Further, a plurality of vacuum pin holes 98 are formed in bottom wall 94 of vacuum forming jig 88 so as to also extend through vacuum plate 89, and are also formed in vacuum plate 89 in surrounding relation to vacuum forming jig 88. Specifically, vacuum pin holes 98 formed in bottom wall 94 are formed immediately adjacent to supporting rails 96, while vacuum pin holes 98 formed in vacuum plate 89 are formed to the outside of vacuum forming jig 88.

With this arrangement, grid-like frame 12 is positioned on vacuum forming jig 88 and vacuum plate 89 such that grid structure 28 is positioned in upper central recess 90 with bars 30 positioned in alignment with and seated on supporting rails 96. Further, the lower edge of outer tray supporting vertical wall 20 seats on vacuum plate 89 with rectangular upstanding peripheral tower 95 fit within side walls 18 of frame 12 with a space therebetween. In such condition, the lower edge of outer tray supporting vertical wall 20 seats outside of vacuum pin holes 98 in vacuum plate 89.

Then, with grid-like frame 12 so situated on vacuum forming jig 88 and vacuum table 89, a thin planar sheet 14 is held at its periphery by a gripping mechanism (not shown) and heated by heating coils (not shown) for a few seconds so as to soften the same. The heated thin planar sheet 14 is then moved by the gripping mechanism to a position immediately above grid-like frame 12 which is held on vacuum forming jig 88 and vacuum table 89. Then, a vacuum from a vacuum source (not shown) and which is positioned below vacuum plate 89, applies a vacuum suction through vacuum pin holes 98 and the vacuum forming jig 88 and vacuum table 89 move upward into contact with the softened sheet 14. As a result, the heated thin planar sheet 14 is drawn down onto grid-like frame 12 by the vacuum suction and conforms to the outer surface of grid-like frame 12. Accordingly, sheet 14 is locked to the upper surface of grid-like frame 12 as a skin. It will be appreciated that air pressure from above sheet 14 can be used in addition to, or alternatively to, the vacuum suction. Ambient air is then blown onto thin sheet 14 to cool the same so that it retains its shape. Then, vacuum forming jig 88 and vacuum table 89 are moved downwardly to separate from the formed sheet 14. To compensate for any misalignment, sheet 14 is made larger than grid-like frame 12 so as to provide a planar periphery that extends outwardly from grid-like frame 12. However, this is cut away in a subsequent cutting operation by a conventional die cut mechanism.

Thus, a plurality of shallow, rectangular, closed-bottom recesses 100 are formed within openings 34, with recesses 100 being defined by a bottom wall 102, and four side walls 104 which conform to the general shape of openings 34. Of course, bottom wall 102 and side walls 104 are formed by thin planar sheet 14 which has been vacuum formed over grid-like frame 12. Thus, thin sheet 14 is formed into the configuration shown in FIGS. 2 and 3.

Because supporting rails 96 have a smaller width than bars 30 of frame 12 and because vacuum pin holes 98 formed in bottom wall 94 are formed immediately adjacent supporting rails 96, sheet 14 is pulled along the sides of bars 30 and then beneath bars 30 and along the sides of supporting rails 96. As a result, a sharp peripheral undercut 106 is formed in side walls 104. It is the undercut that locks sheet 14 in position on frame 12. As will be apparent from the description hereinafter, peripheral undercuts 106 function to retain jewelry pads within recesses 100. Undercuts 106 can be arranged so as to be formed beneath bars 30, beneath corners **32*a*** or beneath both.

Because of the above operation, an inexpensive or recycled plastic can be used to form grid-like frame 12, since grid-like frame 12 is covered by thin sheet 14, thereby rendering jewelry tray 10 less expensive. Further, thin sheet 14 forms a unitary structure without any openings, that is, openings 34 are covered, and thereby thin sheet 14 aids in rendering grid-like frame 12 more rigid. As a result, grid-like frame 12 can be made thinner than conventional jewelry trays, thereby requiring less material without surrendering the structural integrity of jewelry tray 10.

It is possible to die cut holes in bottom walls 102. This may be important to view information on the bottoms of the pads held within the recesses. However, because of the undercuts, the possibility of accidental removal of the pads is remote.

To finalize formation of jewelry tray 10 and to further enhance the structural rigidity of jewelry tray 10, bottom closing member 16 is secured to the underside of grid-like frame 12 and thin sheet 14. Bottom closing member 16 is preferably formed from a thin planar sheet of a flocked PVC material, and is formed into its final configuration preferably in a conventional vacuum forming operation in which the thin sheet is heated and vacuum drawn over a mold to acquire its shape. Then, the configured sheet is cooled by ambient air and withdrawn from the mold.

Figure 6:
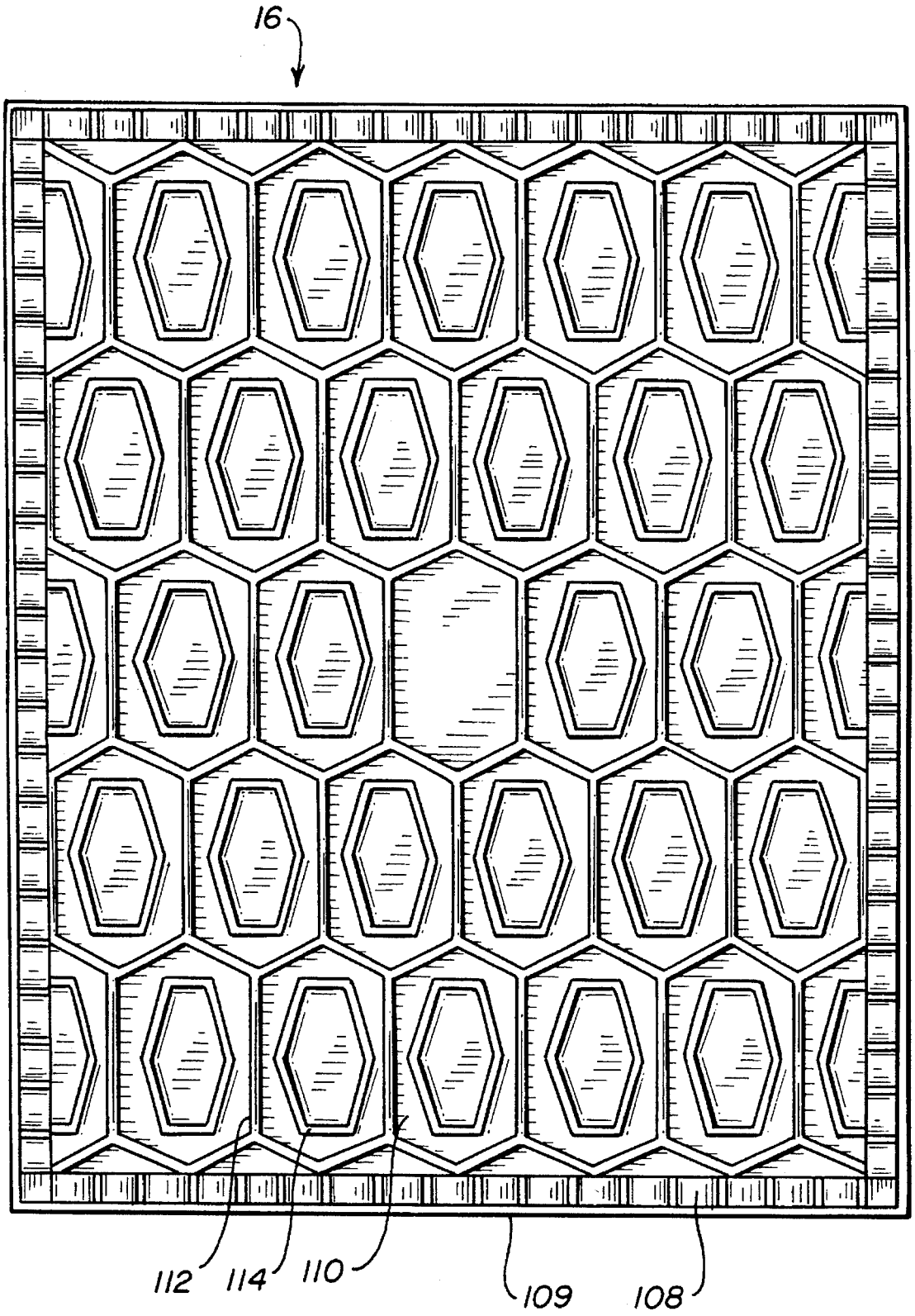
FIG. 6 is bottom plan view of the jewelry tray of FIG. 1.

As shown in FIGS. 2, 3 and 6, in its final configuration, bottom closing member 16 includes a short peripheral rectangular side wall 108, a rectangular central wall 110 of a generally planar configuration connected within and to the upper edge of side wall 108, and a lower sheet portion 109 which extends outwardly in a horizontal plane from the lower edge of side wall 108 when bottom closing member 16 is initially vacuum formed. Side wall 108 has an outer dimension similar to the inner dimension of the lower end of outer tray supporting vertical wall 20 of grid-like frame 12.

Central wall 110 includes a plurality of ribs 112 in a honeycomb configuration and a plurality of hexagonal ribs 114 formed within each hexagon of the honeycomb configuration. As shown, each hexagon formed by ribs 112 and 114 preferably has four sides of equal length and two sides of equal length but of a different length than the four equal sides. Because ribs 112 and 114 do not extend in a continuous straight line across central wall 110 in any direction, that is, because ribs 112 and 114 are discontinuous and broken, there is a large resistance to twisting in any plane. It will be appreciated that the present invention is not limited to a honeycomb or hexagonal pattern, and any other suitable pattern in which the ribs do not extend in a continuous straight line across central wall 110, that is, which is not linear, can be used. It will further be appreciated that the above pattern is specially adapted for a vacuum forming process in view of the use of a thin-walled bottom closing member 16, which is not practically formed in an injection molding operation.

In addition, to enhance the rigidity, a plurality of spaced apart reinforcing ribs 116 are formed partly along the upper portion of short peripheral rectangular side wall 108 and partly along the periphery of rectangular central wall 110. Reinforcing ribs 116 provide a resisting force to inward crushing of the side walls of the jewelry tray. This is important because, often many times, a plurality of stacked trays are held together by a strap which would normally tend to crush the side walls. Ribs 116 resist such crushing.

Bottom closing member 16 is secured to jewelry tray 10 by RF welding and by an adhesive. In this regard, a planar double sided adhesive sheet 118 has one adhesive side thereof adhered to the bottom of the formed thin sheet 14, and particularly, to the underside of bottom walls 102 that extend to a position below bars 30 of frame 12. Then, bottom closing member 16 is inserted within grid-like frame 12 from the lower end thereof such that the upper surface of central wall 110 abuts against the opposite adhesive surface of adhesive sheet 118 and is secured thereto. As a result, the formed thin sheet 14 is further secured and prevented from removal.

In such position, the outer surface of side wall 108 is positioned in abutting relation to the inner surface of outer tray supporting vertical wall 20 of grid-like frame 12, and lower sheet portion 109 is positioned in abutting relation to the lower edge of outer tray supporting vertical wall 20. Thereafter, by use of RF welding, the outer surface of side wall 108, including reinforcing ribs 116, is secured to the inner surface of outer tray supporting vertical wall 20 of grid-like frame 12, and lower sheet portion 109 is secured to the lower edge of outer tray supporting vertical wall 20. In addition, or as an alternative, bottom closing member 16 can be RF welded to the underside of bottom walls 102 of sheet 14. Preferably, when forming bottom closing member 16, lower sheet portion 109 has an outer dimension greater than that of outer tray supporting vertical wall 20 of grid-like frame 12. Accordingly, after an inner part of lower sheet portion 109 is secured to frame 12, any part of lower sheet portion 109 that extends outwardly of outer tray supporting vertical wall 20 of grid-like frame 12, is cut away in a subsequent cutting operation by a conventional die cut mechanism.

It will be appreciated that bottom closing member 16 further rigidifies jewelry tray 10, and particularly, ribs 112, 114 and 116 thereof provide resistance to twisting and to crushing of the side walls. It will be appreciated that the present invention contemplates the use of bottom closing member 16 with other types of trays, such as ring trays and the like.

With the above arrangement, jewelry tray 10 is extremely rigid and resists twisting in any plane. This is due to the closing of openings 34 by thin sheet 14 and by the securement of bottom closing member 16, and particularly, the honeycomb rib structure 112 and 114, and peripheral ribs 116, that function to resist twisting of jewelry tray 10 and crushing of the side walls. Further, jewelry tray 10 is extremely lightweight.

It will be appreciated that a plurality of jewelry trays 10 can be stacked one upon the other despite the use of bottom closing member 16. In so doing, the lower edges of outer tray supporting vertical walls 20 of each jewelry tray 10 are stackable upon short stacking ledges 22 of a lower jewelry tray 10. Further, the use of inclined walls 24 function to guide the lower edges of outer tray supporting vertical walls 20 of each jewelry tray 10 onto short stacking ledges 22 of the lower jewelry tray 10.

As will be appreciated from the discussion which follows, because recesses 100 are much lower than the upper edge of side walls 18 and because central wall 110 is raised from the lower edges of outer tray supporting vertical walls 20, jewelry trays 10 can be stacked one upon the other with the jewelry in one tray being untouched by the jewelry tray 10 stacked thereon.

Figure 7:
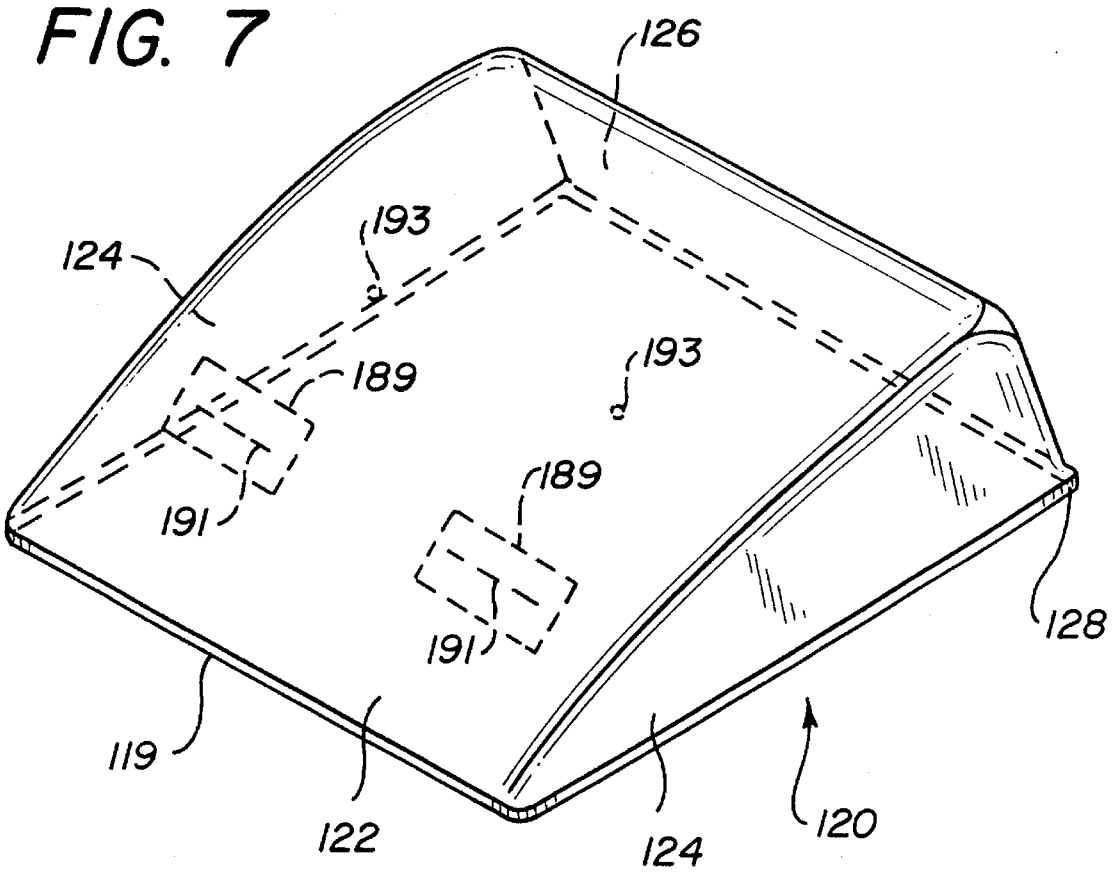
FIG. 7 is perspective view of a pad for use with the jewelry tray of FIG. 1.

In order to retain jewelry items on jewelry tray 10, a plurality of deformable and resilient pads 120 are provided. As shown in FIGS. 3 and 7, each pad 120 has a substantially rectangular upper inclined wall 122 that extends upwardly and rearwardly from a front edge 119 thereof at an inclination of about 15°. The angular orientation provides that earring posts and the like inserted therein do not touch a flat surface when the pad is removed from the tray and placed on the flat surface, while also providing an improved view of the jewelry item. Preferably, inclined wall 122 has a slightly convex bowed configuration. Triangular side walls 124 each have an upper inclined edge connected with a respective side edge of inclined wall 122, and a substantially rectangular rear wall 126 has its upper edge connected with the rear edge of inclined wall 122 and its opposite side edges connected to the rear edges of triangular side walls 124. Preferably, rear wall 126 is inclined rearwardly and downwardly at an inclination of about 15°. In addition, rear wall 126 has a slight concave bowed configuration. With this arrangement, the lower edges of side walls 124 and rear wall 126, along with the front edge of inclined wall 122, lie in the same horizontal plane and support pad 120 on a flat surface. In addition, the lower edges of side walls 124 and rear wall 126, along with the front edge of inclined wall 122, each have a slightly protruding horizontal lip or taper 128 that extends outwardly therefrom.

Preferably, each pad 120 is made from a flexible plastic material that can be deformed but which retains its shape when the deformation force is removed. Alternatively, each pad 120 can be made of a rubber material. In any event, it will be appreciated that each pad 120 has a substantially constant thickness throughout. Thus, posts of earrings or the like can be easily inserted through upper inclined walls 122 of pads 120, with the posts being held at the bottom of pads 120 by earring backings, as is conventional. In addition, if necessary, reduced thickness areas can be formed at the rear surface of upper inclined wall 122 to permit easier insertion of the posts. This can be accomplished by removal of material from the underside of inclined walls 122 in the molding operation, which also provides a marking for insertion of jewelry items such as earring posts, twist pins and the like. Reduced thickness areas can also be provided at rear wall 126 for cutting out, to mount a chain therein.

Each pad 120 fits within a recess 100 of jewelry tray 10, and is held therein. Specifically, a pad 120 is gripped by the fingers of a person and inserted within a recess 100 such that lips 128 bend and slide beneath undercuts 106 so as to be held therein. To remove a pad 120, rear wall 126 thereof is pushed forwardly and upwardly by the finger of a person, wherein pad 120 is removed from below undercuts 106. It will be appreciated that while four undercuts 106 have been discussed relative to each recess 100, less than four undercuts 106 can be used. In fact, it is only necessary that one undercut shoulder 106 be provided, although at least two undercuts 106 for each recess is preferred.

Thus, jewelry tray 10 securely holds pads 120 within recesses 100 by means of undercuts 106. The inclined rear wall 126 of each pad 120 further permits removal of pads 120 from recesses 100. Because pads 120 have a substantially constant thickness throughout, they are thin and therefore easily deformable, while reducing the amount of material that is used.

Figure 10:
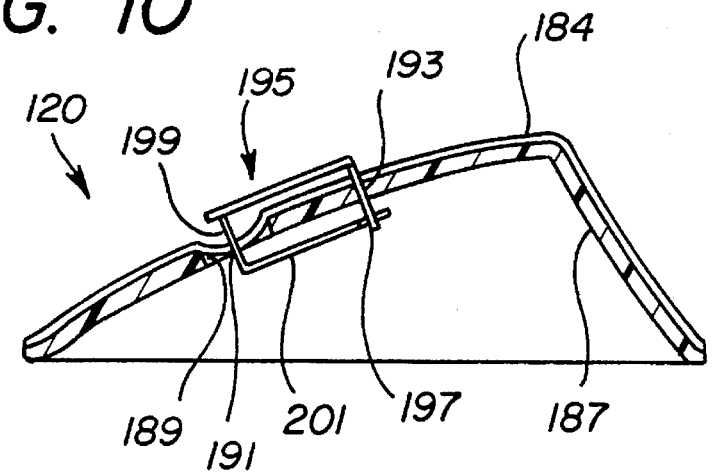
FIG. 10 is a cross-sectional view of a jewelry pad according to another embodiment of the present invention.

One such pad 120 is shown in FIG. 10, and includes a plastic molded part 187 and a fabric material 184 thereon. As shown therein, plastic molded part 187 is formed with at least one rectangular opening 189. This is best shown in FIG. 7 by dashed lines therein. Thus, during the formation of pad 120, fabric material 184 is stretched across and within each opening 189, so as to form reduced thickness areas. A slit 191, also shown be dashed lines in FIG. 7, is formed across fabric material 184 in each opening 189. Further, holes 193 are formed through fabric material 184 and plastic molded part 187 at positions above openings 189. In this manner, an earring 195 having a French style holder can be inserted and held by each pad 120 so as to be raised and easily visible. Specifically, earring 195 may have a circular design 197 with diametrically opposite depending posts 197 and 199, with depending post 197 which functions to fit within a hole in a person's ear, fitting through a hole 193 and with depending post 199 fitting through slit 191. A clasp 201 is pivotally fit on the end of depending post 199 and also fits through slit 191, where it can be pivoted in the closed position shown in FIG. 10.

Of course, side walls 104 can be made much higher, with undercuts 106 extending a desired height of side walls 104 so that an inwardly extending, upper peripheral lip is formed on each side wall 104, above each undercut 106. Thus, a jewelry cup or container can be snapped and locked into each recess 100, being held by such lip and extending into the undercuts 106.

Figure 8:
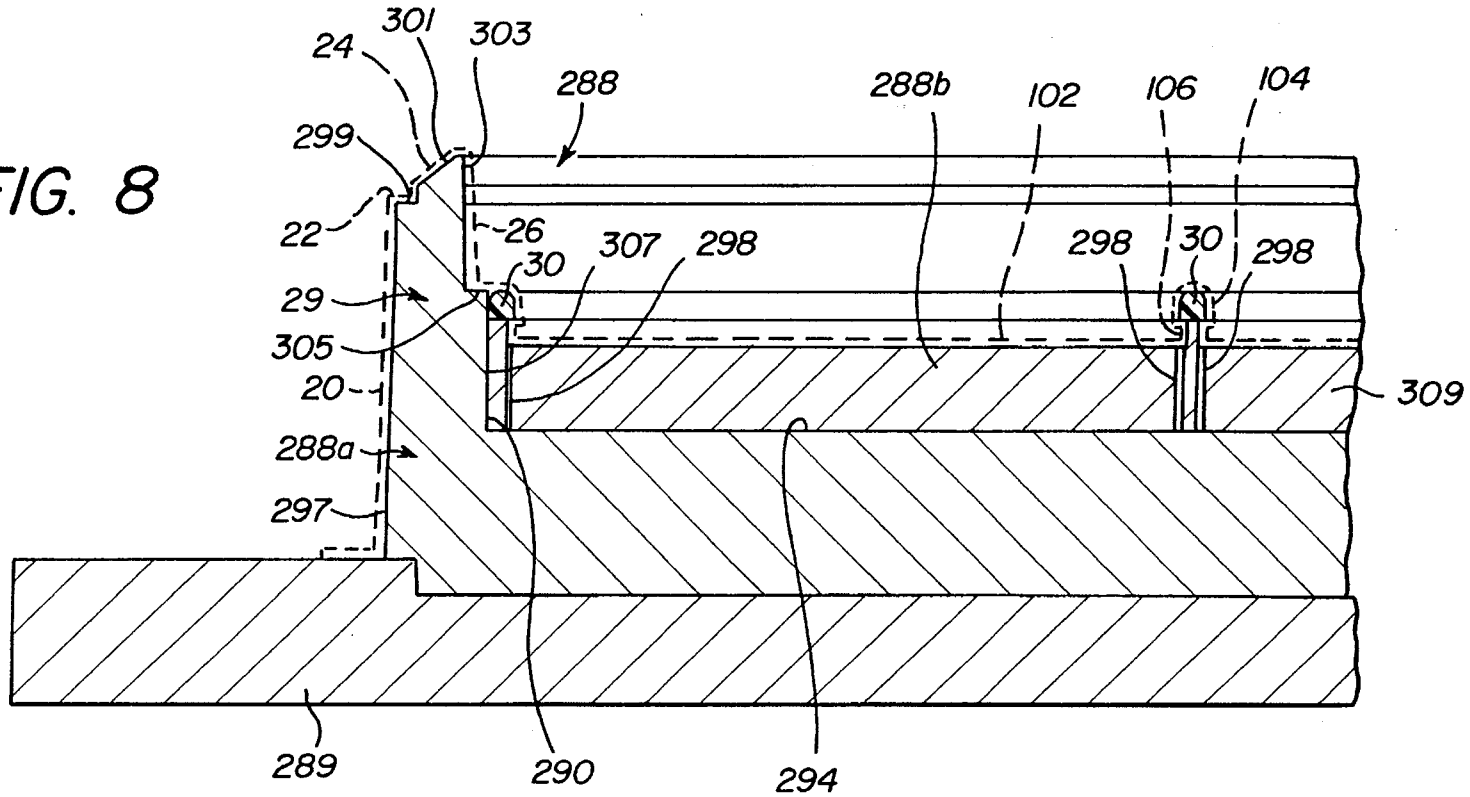
FIG. 8 is a cross-sectional view of a vacuum forming jig for vacuum forming a jewelry tray according to another embodiment of the present invention.

Referring now to FIG. 8, there is shown a vacuum forming jig 288 according to another embodiment of the present invention, for forming jewelry tray 10 according to the present invention.

Specifically, vacuum forming jig 288 includes an outer vacuum forming jig **288*a* which seats on a vacuum plate 289 and has a generally rectangular parallelepiped configuration with an upper central recess 290 defined by a rectangular upstanding peripheral tower 295 in surrounding relation to a lower central recess 290 and a rectangular bottom wall 294. Specifically, rectangular upstanding vertical tower 295 has a configuration similar to side walls 18 but of a smaller dimension, and in this regard, is defined by an outer peripheral vertical wall 297 for defining outer tray supporting vertical walls 20, an inwardly directed peripheral short wall 299 extending inwardly from the upper edge of outer peripheral vertical wall 297 for defining short stacking ledges 22, a peripheral inclined wall 301 extending inwardly and upwardly from the inner free edge of inwardly directed peripheral short wall 299 for defining inclined walls 24, a peripheral side wall 303 extending downwardly from the free upper end of inclined wall 301 so as to be parallel and spaced inwardly of outer peripheral vertical wall 297 for defining inner grid supporting vertical walls 26, a peripheral step 305 formed at the lower end of peripheral side wall 303, and a peripheral recess defining side wall 307 which defines the sides of recess 290**.

Vacuum forming jig 288 further includes an inner vacuum forming jig **288*b* which seats on bottom wall 294 within recess 290, and has outer dimensions which are substantially the same as inner dimensions of peripheral recess defining side wall 307. Specifically, inner vacuum forming jig 288*b* includes a main body 309 of a generally rectangular parallelepiped configuration. A plurality of supporting rails 296 are formed on the upper surface of main body 309 in the same configuration and spacing as bars 30 of grid structure 28. However, supporting rails 296 have a smaller width than bars 30. Further, a plurality of vacuum pin holes 298 are formed in main body 309 of inner vacuum forming jig 288*b*. A manifold or other holes (not shown) is formed through outer vacuum forming jig 288*a* and through vacuum plate 289 to provide vacuum suction to pin holes 298. Specifically, vacuum pin holes 298 formed in main body 309 immediately adjacent to supporting rails 296. A plurality of small vacuum pin holes (not shown) are also formed at other positions in outer vacuum forming jig 288*a* and through vacuum plate 289** to provide suction therethrough, as will be apparent from the discussion which follows.

With this arrangement, side walls 18 are formed in the vacuum forming operation. Specifically, only grid structure 28 is produced in a prior molding operation. Then, grid structure 28 is positioned on supporting rails 296, as shown in FIG. 8, with bars 30 positioned in alignment with and seated on supporting rails 296.

Then, with grid structure 28 so situated on inner vacuum forming jig **288*a*, a planar sheet 14 is held at its periphery by a gripping mechanism (not shown) and heated by heating coils (not shown) for a few seconds so as to soften the same. The heated planar sheet 14 is then moved by the gripping mechanism to a position immediately above vacuum forming jig 288. Then, a vacuum from a vacuum source (not shown) and which is positioned below vacuum plate 289, applies a vacuum suction through vacuum pin holes 298 and vacuum forming jig 288 and vacuum table 289 move upward into contact with the softened sheet 14. As a result, the heated thin planar sheet 14 is drawn down onto vacuum forming jig 288 and grid structure 28 by the vacuum suction and conforms to the outer surface thereof, as shown by the dashed lines in FIG. 8. Accordingly, sheet 14 forms side walls 18 and locks grid structure 28** therein.

It will be appreciated that air pressure from above sheet 14 can be used in addition to, or alternatively to, the vacuum suction. Ambient air is then blown onto sheet 14 to cool the same so that it retains its shape. Then, vacuum forming jig 288 and vacuum table 289 are moved downwardly to separate from the formed sheet 14 and grid structure 28 held thereby. To compensate for any misalignment, sheet 14 is made larger than vacuum forming jig 288 so as to provide a planar periphery that extends outwardly therefrom. However, this is cut away in a subsequent cutting operation by a conventional die cut mechanism.

Thus, a plurality of shallow, rectangular, closed-bottom recesses 100 are formed within openings 34, with recesses 100 being defined by a bottom wall 102, and four side walls 104 which conform to the general shape of openings 34. Of course, bottom wall 102 and side walls 104 are formed by thin planar sheet 14 which has been vacuum formed over grid structure 28. Thus, sheet 14 is formed into the configuration shown in FIGS. 2 and 3.

Because supporting rails 296 have a smaller width than bars 30 of grid structure 28 and because vacuum pin holes 298 are formed in main body 309 immediately adjacent to supporting rails 296, sheet 14 is pulled along the sides of bars 30 and then beneath bars 30 and along the sides of supporting rails 296. As a result, a sharp peripheral undercut 106 is formed in side walls 104. It is the undercut that locks sheet 14 in position on grid structure 28. As discussed above, peripheral undercuts 106 function to retain jewelry pads within recesses 100. Undercuts 106 can be arranged so as to be formed beneath bars 30, beneath corners **32*a*** or beneath both.

It will be appreciated that sheet 14 used with the embodiment of FIG. 8 is thicker than sheet 14 used with the first described embodiment, since side walls 18 are also formed by such sheet 14 in FIG. 8, and thereby need to be of a greater strength. As a result, the jewelry 10 formed by the structure of FIG. 8 will be sturdier, but will also be heavier.

Figure 9:
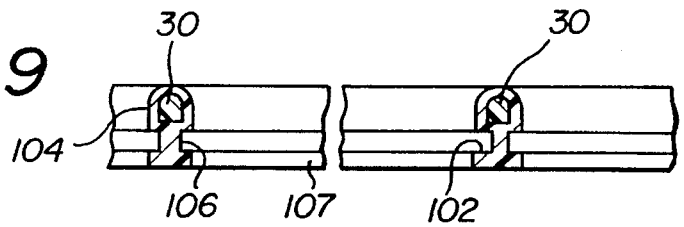
FIG. 9 is an exploded cross-sectional view of a portion of a jewelry tray formed by the vacuum forming jig of FIG. 8.

In order to reduce the weight thereof, it is possible to die cut holes 107 in bottom walls 102, as shown in FIG. 9. This may be important to view information on the bottoms of pads 120 held within recesses 100. However, because of undercuts 106, the possibility of accidental removal of pads 120 is remote. This is because some portion of each bottom wall 102 will still remain to provide support therefor, in combination with undercuts 106, as shown in FIG. 9.

Further, a clear, thin transparent sheet of plastic (not shown) can be placed in each recess 100 and held by undercuts 106 and the remaining portions of bottom walls 102.

To finalize formation of this latter jewelry tray 10 and to further enhance the structural rigidity of jewelry tray 10, bottom closing member 16 is secured to the underside of the formed structure, as in the first embodiment. However, in the event that die cut holes 107 are formed in bottom walls 102, there is less material to secure to bottom closing member. Accordingly, the honeycomb structure of bottom closing member 16 can be eliminated, in order to provide better securement by RF welding or the like of bottom closing member 16 to the underside of the remaining uncut portion of bottom walls 102.

Having described specific preferred embodiments of the invention with reference to the accompanying drawings, it will be appreciated that the present invention is not limited to those precise embodiments and that various changes and modifications can be effected therein by one of ordinary skill in the art without departing from the scope or spirit of the invention defined by the appended claims.

What is claimed is:

1. A jewelry tray comprising:

a peripheral supporting wall; and a center portion connected within said peripheral supporting wall, said center portion including a plurality of recesses therein, each said recess being defined by a peripheral side wall and a bottom wall, said bottom wall of each said recess extending at least partially inwardly of the respective said recess, each said recess including two undercut portions on opposite sides of said recess, each undercut portion extending at a lower end of the peripheral side wall thereof, and a portion of said bottom wall being disposed beneath each said undercut portion to define an inner ledge for supporting a jewelry pad thereon; and said center portion including a grid structure formed by a plurality of intersecting bars connected within said peripheral supporting wall to define said peripheral side walls of said recesses, said grid structure being open between said plurality of intersecting bars to define openings wherein there is no bottom wall between said intersecting bars; and a thin sheet of material formed as a skin on an upper surface of said grid structure so as to extend within said openings and partially surround a bottom of said grid structure, thereby defining said bottom walls of said plurality of recesses, and said thin sheet of material extends outwardly from said center portion and is shaped thereat to form said peripheral supporting wall.

2. A jewelry tray according to claim 1, wherein said peripheral supporting wall includes:

an outer tray supporting vertical wall for supporting the jewelry tray on a surface;

a short stacking ledge extending inwardly from an upper edge of the outer tray supporting vertical wall for supporting a lower edge of the outer tray supporting vertical wall of another said jewelry tray thereon;

an inclined wall extending inwardly and upwardly from an inner edge of the short stacking ledge; and an inner center portion supporting vertical wall extending downwardly from an inner, upper edge of the inclined wall and for supporting said center portion at a lower edge thereof.

3. A jewelry tray according to claim 1, wherein said plurality of intersecting bars are connected together by intersecting corners for defining said plurality of openings.

4. A jewelry tray according to claim 3, wherein the peripheral side wall of each said recess extends:

along sides of said intersecting bars and said intersecting corners corresponding to said recess, and substantially parallel to said sides of and below at least one of:

(a) said intersecting bars, and (b) said intersecting corners, so as to define at least one undercut portion at a lower end of said peripheral side wall in each said recess.

5. A jewelry tray according to claim 1, further including a bottom closing member secured to said peripheral supporting wall and to an underside of said center portion.

6. A jewelry tray according to claim 1, further including a plurality of deformable and resilient pads for holding jewelry items, each said pad being held within a respective said recess on said inner ledge thereof.

7. A jewelry tray according to claim 6, wherein each said pad includes a lower edge with a slightly protruding horizontal lip that extends outwardly therefrom for engaging within at least one undercut portion.

8. A jewelry tray comprising:

a grid-like frame including a peripheral supporting wall and a grid structure formed by a plurality of intersecting bars connected within said peripheral supporting wall, said grid structure being open between said plurality of intersecting bars to define openings, wherein there is no bottom wall between said intersecting bars; and a thin sheet of material forming a skin on an upper surface of said grid-like frame and extending within said openings to define a plurality of recesses including side walls formed by portions of said thin sheet hanging down from said intersecting bars and bottom walls between said side walls and formed by other portions of said thin sheet between said side walls.

9. A jewelry tray according to claim 8, wherein said grid structure and said thin sheet of material are each formed from a plastic material.

10. A jewelry tray according to claim 8, wherein said peripheral supporting wall includes:

an outer tray supporting vertical wall for supporting the jewelry tray on a surface;

a short stacking ledge extending inwardly from an upper edge of the outer tray supporting vertical wall for supporting a lower edge of the outer tray supporting vertical wall of another said jewelry tray thereon;

an inclined wall extending inwardly and upwardly from an inner edge of the short stacking ledge; and an inner center portion supporting vertical wall extending downwardly from an inner, upper edge of the inclined wall and for supporting said center portion at a lower edge thereof.

11. A jewelry tray according to claim 8, wherein said plurality of intersecting bars are connected together by intersecting corners for defining said plurality of openings.

12. A jewelry tray according to claim 11, wherein each said recess is defined by a peripheral side wall and a bottom wall, each said peripheral side wall extending along sides of said intersecting bar means and said intersecting corners, and extending beneath at least one of:

(a) at least one said bar means, and (b) at least one said intersecting corner of said bar means, for each recess so as to define at least one undercut portion at a lower end of said peripheral side wall in each said recess.

13. A jewelry tray according to claim 8, further including a bottom closing member secured to an underside of said grid-like frame.

14. A jewelry tray according to claim 13, further including adhesive means for adhesively securing an upper surface of said bottom closing member to undersurfaces of said bottom walls of said recesses.

15. A jewelry tray according to claim 13, wherein said bottom closing member is secured to an underside of said peripheral supporting wall of said grid-like frame by means of RF welding.

16. A jewelry tray according to claim 13, wherein said bottom closing member includes:

a short peripheral wall; and a central wall of a generally planar configuration connected within and to the short peripheral wall.

17. A jewelry tray according to claim 16, wherein said central wall includes a plurality of twist resisting ribs formed therein for providing a resistance to twisting of said jewelry tray, said ribs are provided as projections of the central wall which are out of the plane of the central wall.

18. A jewelry tray comprising:

a grid-like frame including a peripheral supporting wall and a grid structure connected within said peripheral supporting wall, said grid structure including a plurality of openings;

a thin sheet of material forming a skin on an upper surface of said grid-like frame and extending within said openings to define a plurality of recesses; and a bottom closing member secured to an underside of said grid-like frame, said bottom closing member including:

a short peripheral wall; and a central wall of a generally planar configuration connected within and to the short peripheral wall, said central wall including a plurality of twist resisting ribs formed therein for providing a resistance to twisting of said jewelry tray, said ribs including a plurality of ribs in a honeycomb configuration formed of a plurality of hexagons, and a plurality of hexagonal ribs formed within each hexagon of the honeycomb configuration.

19. A jewelry tray according to claim 16, wherein said short peripheral wall includes a plurality of reinforcing ribs formed therein for providing a resistance to inward crushing of the supporting wall of the frame, a portion of each said reinforcing rib being provided in said short peripheral wall and another portion of each said reinforcing rib being provided in said central wall so as to project out of the plane of the central wall.

20. A jewelry tray according to claim 12, wherein said grid-like frame includes a plurality of pin holes therein through which a vacuum can be applied for vacuum forming said thin sheet of material as a skin on the upper surface of said grid-like frame and so that said thin sheet extends within said openings to define said plurality of recesses.

21. A jewelry tray according to claim 8, further including a plurality of deformable and resilient pads of substantially constant thickness throughout, for holding jewelry items, each said pad being held within a respective said recess.

22. A jewelry tray according to claim 20, wherein each said pad includes a lower edge with a slightly protruding horizontal lip that extends outwardly therefrom for engaging with at least one undercut portion of said jewelry tray in each said recess.

23. A jewelry tray comprising:

a frame including a peripheral supporting wall and a center portion connected within said peripheral supporting wall for holding jewelry items; and a bottom closing member secured to an underside of said frame, said bottom closing member including twist resistant ribs formed therein for resisting twisting of said jewelry tray, said bottom closing member including:

a short peripheral wall; and a central wall of a generally planar configuration connected within and to the short peripheral wall, and said ribs are provided in said central wall;

said ribs including a plurality of ribs in a honeycomb configuration formed of a plurality of hexagons, and a plurality of hexagonal ribs formed within each hexagon of the honeycomb configuration.

24. A jewelry tray comprising:

a plastic grid-like frame including a peripheral supporting wall and a grid structure connected within said peripheral supporting wall, said grid structure formed by a plurality of intersecting bars connected together by intersecting corners and within said peripheral supporting wall, said grid structure being open between said plurality of intersecting bars to define openings wherein there is no bottom wall between said intersecting bars;

a thin sheet of plastic material forming a skin on an upper surface of said grid-like frame and extending within said openings to define a plurality of recesses, each said recess being defined by side walls formed by portions of said thin sheet hanging down from said intersecting bars and bottom walls between said side walls and formed by other portions of said thin sheet between said side walls, each said peripheral side wall extending:

along sides of said intersecting bars and said intersecting corners corresponding to said recess, and substantially parallel to said sides and below at least one of:

(a) said intersecting bars, and (b) said intersecting corners so as to define at least one undercut portion at a lower end of said peripheral side wall in each said recess;

a bottom closing member secured to an underside of said grid-like frame, said bottom closing member including a short peripheral wall and a central wall of a generally planar configuration connected within and to the short peripheral wall, said bottom closing member including:

a plurality of twist resisting ribs formed in said central wall for providing a resistance to twisting of said jewelry tray, and a plurality of reinforcing ribs formed in said central wall and said short peripheral wall for providing a resistance to inward crushing of said peripheral supporting wall; and a plurality of deformable and resilient pads for holding jewelry items, each said pad being held within a respective said recess, each said pad including a lower edge with a slightly protruding horizontal lip that extends outwardly therefrom for engaging with at least one undercut portion.

* * * * *

UNITED STATES PATENT AND TRADEMARK OFFICE

CERTIFICATE OF CORRECTION

PATENT NO. : 5,511,653

DATED : April 30, 1996

INVENTOR(S) : Joseph Ovadia

It is certified that error appears in the above-indentified patent and that said Letters Patent is hereby corrected as shown below:

Column 15, line 50, cancel "means";

line 50, after "corners" insert --corresponding to said recess--;

line 51, change "extending beneath" to --substantially parallel to said sides of and below--;

line 52, change "at least one said bar means" to --said intersecting bars--;

line 53, cancel "at least one";

line 53, change "corner of said bar means" to --corners--;

UNITED STATES PATENT AND TRADEMARK OFFICE

CERTIFICATE OF CORRECTION

PATENT NO. : 5,511,653

DATED : April 30, 1996

INVENTOR(S) : Joseph Ovadia

It is certified that error appears in the above-indentified patent and that said Letters Patent is hereby corrected as shown below:

Column 15, line 54, cancel "for each recess".

Signed and Sealed this

Twenty-third Day of July, 1996

*Attest:*

Bruce Lehman

BRUCE LEHMAN

*Attesting Officer*

*Commissioner of Patents and Trademarks*